US009085939B2

(12) United States Patent
McClain et al.

(10) Patent No.: US 9,085,939 B2
(45) Date of Patent: Jul. 21, 2015

(54) EARTH-BORING TOOLS ATTACHABLE TO A CASING STRING AND METHODS FOR THEIR MANUFACTURE

(75) Inventors: Eric E. McClain, Spring, TX (US); Matthew R. Isbell, Houston, TX (US); Jack Thomas Oldham, Conroe, TX (US); John C. Thomas, Lafayette, LA (US); Marc W. Bird, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 997 days.

(21) Appl. No.: 12/270,944

(22) Filed: Nov. 14, 2008

(65) Prior Publication Data

US 2009/0120693 A1 May 14, 2009

Related U.S. Application Data

(60) Provisional application No. 60/987,848, filed on Nov. 14, 2007.

(51) Int. Cl.

| | |
|---|---|
| ***E21B 10/42*** | (2006.01) |
| ***E21B 7/20*** | (2006.01) |
| ***E21B 10/64*** | (2006.01) |

(52) U.S. Cl.

CPC . *E21B 7/20* (2013.01); *E21B 10/42* (2013.01); *E21B 10/64* (2013.01); *Y10T 29/49966* (2013.01)

(58) Field of Classification Search

USPC ..... 175/402, 413

See application file for complete search history.

(56) References Cited

U.S. PATENT DOCUMENTS

| | | | | |
|---|---|---|---|---|
| 4,499,795 | A | 2/1985 | Radtke | |
| 5,433,280 | A | 7/1995 | Smith | |
| 5,544,704 | A * | 8/1996 | Laurel et al. | 166/117.6 |
| 5,937,955 | A * | 8/1999 | Nims et al. | 175/61 |
| 5,957,225 | A | 9/1999 | Sinor | |
| 6,062,326 | A * | 5/2000 | Strong et al. | 175/402 |
| 6,443,247 | B1 * | 9/2002 | Wardley | 175/402 |
| 7,096,982 | B2 | 8/2006 | McKay et al. | |
| 7,117,960 | B2 * | 10/2006 | Wheeler et al. | 175/171 |
| 7,275,605 | B2 | 10/2007 | Smith et al. | |
| 7,395,882 | B2 | 7/2008 | Oldham et al. | |
| 7,413,020 | B2 | 8/2008 | Carter et al. | |
| 2004/0226751 | A1 * | 11/2004 | McKay et al. | 175/57 |
| 2005/0103530 | A1 * | 5/2005 | Wheeler et al. | 175/171 |

(Continued)

FOREIGN PATENT DOCUMENTS

WO 2004079150 A2 9/2004

OTHER PUBLICATIONS

Merriam-Webster Dictionary, "Definition of Integral" and "Definition of case hardened" accessed Aug. 30, 2010.*

(Continued)

*Primary Examiner* — Blake Michener

(74) *Attorney, Agent, or Firm* — Steve Rosenblatt

(57) ABSTRACT

Casing bits include a bit crown having a substantially hollow interior. The bit crown has blades over a face portion thereof, the blades including a plurality of cutting elements attached thereto. The bit crown further includes a composite inlay positioned at least within the substantially hollow interior. The casing bits also include case hardened outer surfaces radially outside a drill-out region. The casing bits further include short-substrate cutting elements. Methods of forming a casing bit are also disclosed.

32 Claims, 3 Drawing Sheets

(56) References Cited

U.S. PATENT DOCUMENTS

| | | | | |
|---|---|---|---|---|
| 2005/0183892 | A1* | 8/2005 | Oldham et al. | 175/402 |
| 2006/0278442 | A1* | 12/2006 | Kristensen | 175/393 |
| 2007/0079995 | A1* | 4/2007 | McClain et al. | 175/426 |
| 2007/0107942 | A1* | 5/2007 | Overstreet et al. | 175/57 |
| 2010/0307837 | A1* | 12/2010 | King et al. | 175/344 |
| 2011/0061941 | A1* | 3/2011 | Twardowski et al. | 175/393 |

OTHER PUBLICATIONS

Dictionary definitions of "composite" and "adhesive", accessed via thefreedictionary.com on Jan. 6, 2012.*

PCT International Search Report for PCT/US2008/083528, mailed Apr. 9, 2009.

* cited by examiner

EARTH-BORING TOOLS ATTACHABLE TO A CASING STRING AND METHODS FOR THEIR MANUFACTURE

CROSS-REFERENCE TO RELATED APPLICATION

This application claims the benefit of U.S. Provisional Patent Application Ser. No. 60/987,848, filed Nov. 14, 2007, the disclosure of which is incorporated herein by reference in its entirety.

TECHNICAL FIELD

The present invention, in various embodiments, relates generally to earth-boring tools and methods of forming earth-boring tools. More particularly, embodiments of the present invention are directed to earth-boring tools and methods for forming earth-boring tools attachable to a casing string.

BACKGROUND

Drilling wells for oil and gas production conventionally employs a longitudinally extending "string" comprising sections of drill pipe with heavy walled drill "collars" at the end to which is secured a drill bit of a larger diameter than the pipe. After a selected portion of the bore hole has been drilled, a string of tubular members of lesser diameter than the bore hole, known as a casing string, is placed in the bore hole. Subsequently, the annulus between the wall of the bore hole and the outside of the casing string is filled with cement by pumping the cement down through a so-called "flat shoe" at the end of the casing and, in some instances, through apertures in cementing collars at intervals in the casing string. Therefore, drilling and running and cementing casing according to the conventional process typically requires sequentially drilling the bore hole using drill string with a drill bit attached thereto, removing the drill string and drill bit from the bore hole, and disposing and cementing a casing into the bore hole. Further, often after a section of the bore hole is lined with casing and cemented, additional drilling beyond the end of the casing string or through a sidewall of the casing string may be desired. In some instances, a string of smaller tubular members, known as a liner string, is run and cemented within previously run casing. As used herein, the term "casing" includes tubular members in the form of liners.

Unfortunately, sequential drilling and casing may be time consuming because, as may be appreciated, at the considerable depths reached during oil and gas production, the time required to implement complex retrieval procedures to recover the drill string may be considerable. Thus, such operations may be costly as well, since, for example, the beginning of profitable production can be greatly delayed. Moreover, control of the well may be difficult during the period of time that the drill pipe is being removed and the casing is being disposed into the bore hole.

Some approaches have been developed to address the difficulties associated with conventional drilling and casing operations and to increase efficiency. One such approach includes drilling with casing. Drilling with casing employs a drill bit, termed a "casing bit," attached to the end of the casing string. U.S. patent application Ser. No. 10/783,720, assigned to the assignee of the present invention and the entire disclosure of which is incorporated herein by this reference, discloses various embodiments of casing bits and methods of drilling with casing. The casing bit functions not only to drill the earth formation, but also to guide the casing into the bore hole, and remains in place during cementing of the casing in place. The casing string is, thus, run into the bore hole as it is formed by the casing bit through application of weight-on-bit (WOB) and rotation of the casing string, eliminating the necessity of retrieving a drill string and drill bit after reaching a target depth where cementing is desired.

While this procedure greatly increases the efficiency of the drilling procedure, a further problem is encountered when the casing is cemented upon reaching the desired depth. While one advantage of drilling with casing is that the drill bit does not have to be retrieved from the well bore, further drilling may be required. For instance, cementing may be done for isolating certain subterranean strata from one another along a particular extent of the bore hole, but not at the desired depth. Thus, further drilling must pass through or around the drill bit attached to the end of the casing.

Drilling through the previous drill bit in order to advance may be difficult, as drill bits are required to remove rock from formations and, accordingly, often include drilling very resistant, robust structures typically manufactured from materials such as tungsten carbide, polycrystalline diamond, or steel. Attempting to drill through a drill bit affixed to the end of a casing may result in damage to the subsequent drill bit and bottom-hole assembly deployed or possibly the casing itself. It may be possible to drill through a drill bit or a casing with special tools known as mills, but these tools are unable to penetrate rock formations effectively and the mill would have to be retrieved or "tripped" from the hole and replaced with a drill bit. In this case, the time and expense saved by drilling with casing would have been lost.

BRIEF SUMMARY

The present invention is directed to earth-boring tools and methods for forming earth-boring tools attachable to a casing string which are more easily drilled through. Various embodiments of the present invention comprise a bit crown for use in drilling a bore hole with casing. In one or more embodiments, the bit crown may comprise a substantially hollow body comprising a generally rounded face at one longitudinal end thereof. Two or more blades may extend generally radially outward over the face from a center of the face. At least one blade of the two or more blades may comprise a recess extending from inside the substantially hollow body into a portion of the at least one blade. A plurality of cutting elements may be attached to each of the two or more blades.

Other embodiments comprise an earth-boring tool attachable to a casing string. One or more embodiments of such earth-boring tools may comprise a crown comprising a generally cylindrical hollow body. The hollow body may comprise an open end and a longitudinally opposing, closed end. The closed end of the hollow body may comprise a generally rounded face. A plurality of blades may be positioned on the face and may extend radially outward from the face. A plurality of cutting elements may be attached to the plurality of blades. At least some of the plurality of cutting elements may comprise polycrystalline diamond compact material bonded to a short substrate on which the PDC material is formed. A structural inlay comprising a composite material may be positioned at least within a portion of the hollow body.

Still other embodiments of the present invention comprise methods for forming earth-boring tools which may be attachable to a casing string. One or more embodiments of such methods may comprise forming a bit body comprising a face at one longitudinal end thereof and a substantially hollow interior. At least one blade may be formed and located to extend radially over the face. One or more cutting elements may be attached to the at least one blade. An inlay may be formed of a composite material and may be positioned at least inside a portion of the hollow interior of the bit body.

DETAILED DESCRIPTION

The illustrations presented herein are, in some instances, not actual views of any particular drill bit or structural inlay, but are merely idealized representations which are employed to describe the present invention. Additionally, elements common between figures may retain the same numerical designation.

In the following description, certain terminology is used to describe certain features of one or more embodiments of the invention. For instance, the term "drill-out diameter" refers to the inner diameter of a casing drill bit which may be drilled through by a subsequent drill bit run within the casing string in order to continue the bore hole beyond the depth where the casing bit has been positioned.

Figure 1:
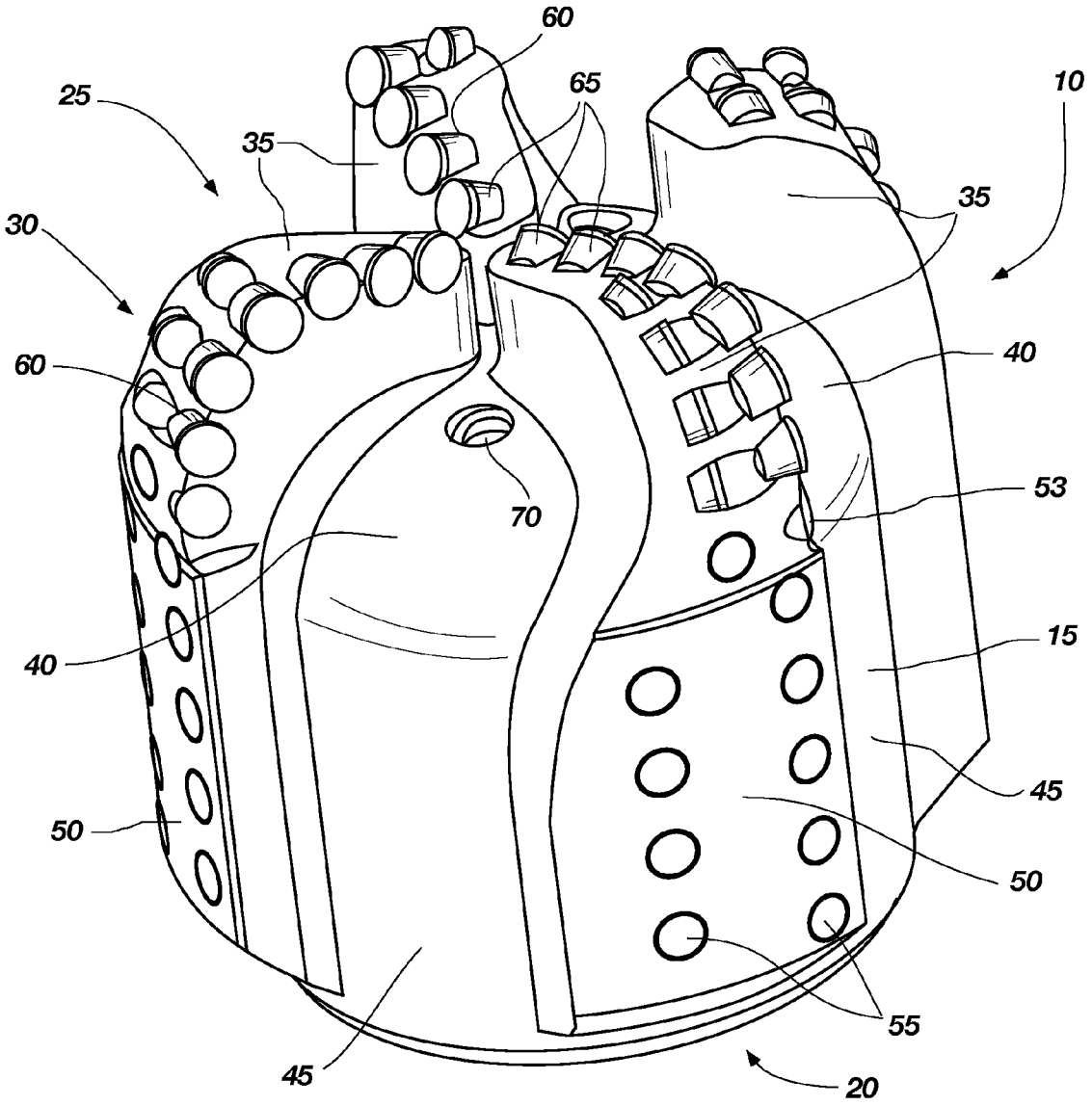
FIG. 1 depicts an isometric view of a casing bit crown or frame according to at least some embodiments of the present invention.

Various embodiments of the present invention are directed toward embodiments of earth-boring tools configured for drilling with casing, conventionally known as "casing bits." FIG. 1 is an isometric views of a casing bit crown 10 according to at least some embodiments of the present invention. The bit crown 10, which may also be referred to herein as a frame, includes a generally cylindrical, hollow bit body 15 that is open at one longitudinal end 20 and closed at a second, opposing longitudinal end 25. The closed end 25 comprises a leading end of the bit body 15 (as the casing bit would be oriented during drilling) and includes a generally rounded nose or face 30. The face 30 includes a plurality of blades 35 disposed thereon and extending radially outward and upward about the bit body 15, forming fluid courses 40 extending to junk slots 45 between circumferentially adjacent blades 35. Blades 35 may extend generally radially outward from proximate a center of the face 30 and increasingly forward of the face 30 from proximate the center to locations proximate the outer side surface of the bit body 15.

Each of the blades 35 may include a gage region 50 which is configured to define the outermost radius of the bit crown 10 and, thus, the radius of the wall surface of a bore hole drilled thereby. The outermost radius of the casing bit crown 10 is greater than the outermost radius of the casing or liner string (not shown) used to form and line the bore hole, so as to provide an annulus between the casing or liner string and the bore hole wall. Gage regions 50 comprise longitudinally upward (as the drill bit is oriented during use) extensions of the blades 35 and may include cutting elements in the form of gage trimmers 53 of natural or synthetic diamond for cutting the final gage dimension of the bore hole, hardfacing material, or wear-resistant inserts 55, such as tungsten carbide inserts, as well as combinations thereof on radially outer surfaces of the gage regions 50 to inhibit excessive wear thereto.

Blades 35 may also include pockets 60 on rotationally leading surfaces thereof sized and configured to receive cutting elements 65. Pockets 60 may also be formed rotationally behind the leading surfaces of the blades 35 to receive cutting elements in the form of so-called "back-up" cutters having a reduced exposure in comparison to the cutting elements 65 on the leading faces of blades 35. Cutting elements 65 may be affixed upon the blades 35 by way of brazing, welding, or as otherwise known in the art. Cutting elements 65 are configured for cutting through subterranean formations, and may, therefore, comprise superabrasive material such as, by way of a non-limiting example, a polycrystalline diamond compact (PDC) layer or "table." Other suitable materials may be employed as cutting elements 65, such as thermally stable polycrystalline diamond compacts or "TSPs," diamond grit-impregnated segments, or cubic boron nitride. In embodiments employing PDC cutting elements, the PDC table is bonded to a supporting substrate of, for example, cemented tungsten carbide, as is well known in the art.

It is also known in the art to form such PDC cutting elements on a short substrate, which is later bonded to a longer substrate to provide greater stiffness for support of the PDC table, such short-substrate cutting elements conventionally referred to as "short-substrate" or "LS-bond"-suitable cutting elements. By way of example and not limitation, the short substrate in at least some embodiments may comprise a length between about 0.100 inch to 0.500 inch. In some embodiments of the invention, short-substrate cutting elements may be employed without the addition of the long substrate. Such a configuration may reduce the amount of hard-to-drill tungsten carbide material comprising each cutting element, thus reducing the amount of material a successive earth-boring tool in the form of a drill bit may be required to drill through when drilling out a previously positioned earth-boring tool of the present invention and reducing the potential for cutting element damage to the drill bit. In addition, with embodiments employing short-substrate cutting elements, the blades 35 may be configured to be thinner, in terms of sweep in a circumferential direction, over at least the portion of the face 30, which may be drilled through by a successive earth-boring tool. A thinner blade may reduce the total volume of the blades 35 over that portion of the casing bit crown 10 potentially subject to being drilled through.

Nozzles 70 in orifices in the face 30 are used to direct drilling fluid from the interior of the bit body 15 to fluid courses 40. The drilling fluid is provided to remove formation cuttings and cool and lubricate the cutting elements 65.

In some embodiments of a casing bit, the blades 35 may include a hardfacing material selectively applied over a portion thereof. By way of example and not limitation, the blades 35 may include hardfacing applied over at least one of the rotationally forward portion of the blade 35, the top of the blade 35, between adjacent cutting elements 65, and the back of the blade 35. Different types of hardfacing materials are known in the art and any suitable hardfacing material may be used. The use of hardfacing material over portions of a steel bit crown that are subjected to erosion by drilling fluid or abrasion of the formation being drilled may be effective to prolong the life of the casing bit while still preserving subsequent drillability thereof.

In some embodiments of a casing bit, the blades 35 may be formed integral to the bit body 15. In other embodiments, the blades 35 may be separate from and separately attached to the bit body 15. In the latter embodiments, the blades may be attached using a fastener or an adhesive, as well as combinations thereof. By way of a non-limiting example, the blades 35 may be attached to the bit body 15 as schematically shown as 101 in FIG. 2 by bolting, screwing, brazing, welding or gluing the blades 35 to the bit body 15, as well as combinations thereof. By way of example and not limitation, the blades 35 may comprise steel or other metal alloy, an aluminum, or a composite material such as fibers in an epoxy matrix, as further discussed below. In such embodiments, the blades 35 may comprise the same or similar material as the bit body 10 or the blades may comprise a different material.

In still other embodiments, the face 30 of the bit body 15 may comprise an incomplete face structure. Such an incomplete face structure may comprise one or more apertures therein. The blades 35 may be attached to the bit body 15 from the interior hollow portion of the bit body 15 and extend away from the face 30. By way of example and not limitation, the face 30 may be formed comprising a plurality of apertures at those positions where the blades 35 are to be formed. A plurality of blades 35 may be attached to the interior portion of the hollow bit body 15 and extend through the apertures of the incomplete face structure of the bit body 15. Such blades 35 may be coupled to or formed integral with a structural inlay described in more detail below.

Figure 2:
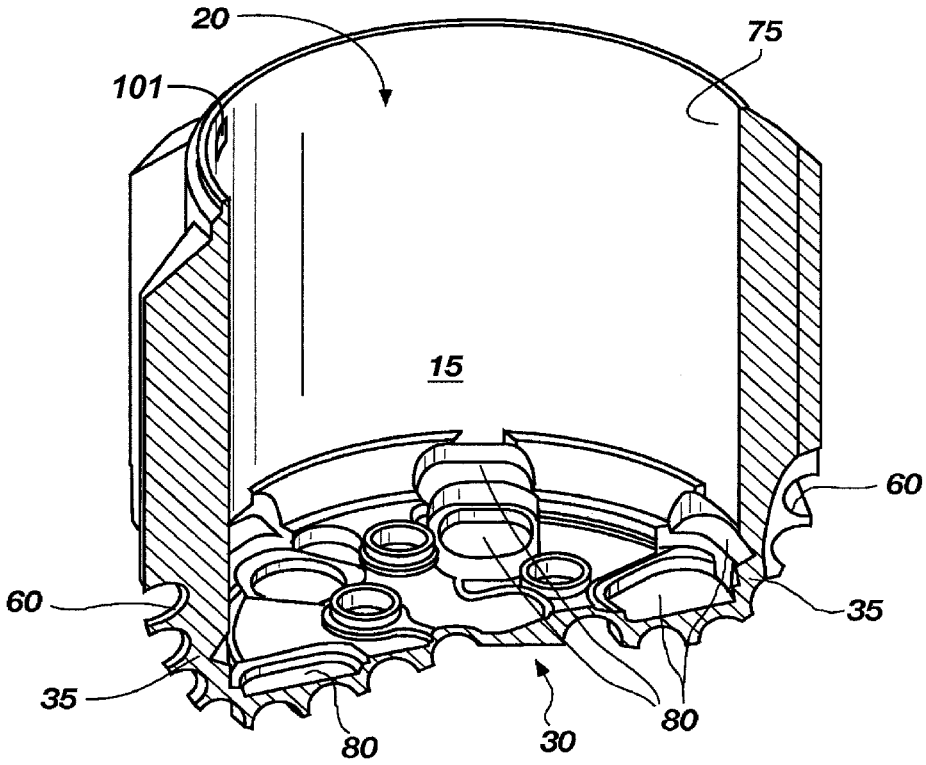
FIG. 2 depicts a cross-sectional view of a bit crown or frame according to at least some embodiments.

The hollow bit body 15 may be comprised of a metal or metal alloy material of sufficient strength to drill through subterranean formation. By way of example and not limitation, the bit body 15 may comprise a steel alloy. FIG. 2 illustrates a cross-sectional view of a frame according to at least some embodiments. As depicted in FIG. 2, the wall 75 of the bit body 15 is constructed to be relatively thin at least at the face 30, as compared to conventional bits. The thickness of the wall 75 of the bit body 15 is sufficiently thick to provide a layer of durable material for contact with and drilling through subterranean formation, while providing a reduced amount of material to be drilled through by a subsequent drill bit. By way of example and not limitation, in some embodiments the wall 75 of the bit body 15 may comprise a thickness in the range between about 0.050 inch and 0.200 inch.

In some embodiments, the blades 35 may include recesses 80 formed therein at the face 30 and the shoulder region. Because the blades 35 are upstanding from the face 30, the blades 35 generally comprise a thicker wall than the rest of the face 30. Therefore, recesses 80 may be formed in the interior of the bit body 15, the recesses 80 correlating with the blades 35 to reduce the wall thickness of the blades 35. Such recesses 80 may reduce a substantial amount of metal material comprising the blades 35 providing a wall thickness for each blade 35, which is comparable to the thickness of the wall 75 of the rest of the face 30, and reducing the total volume of metal or metal alloy to be drilled through subsequently by a drill bit.

Figure 3:
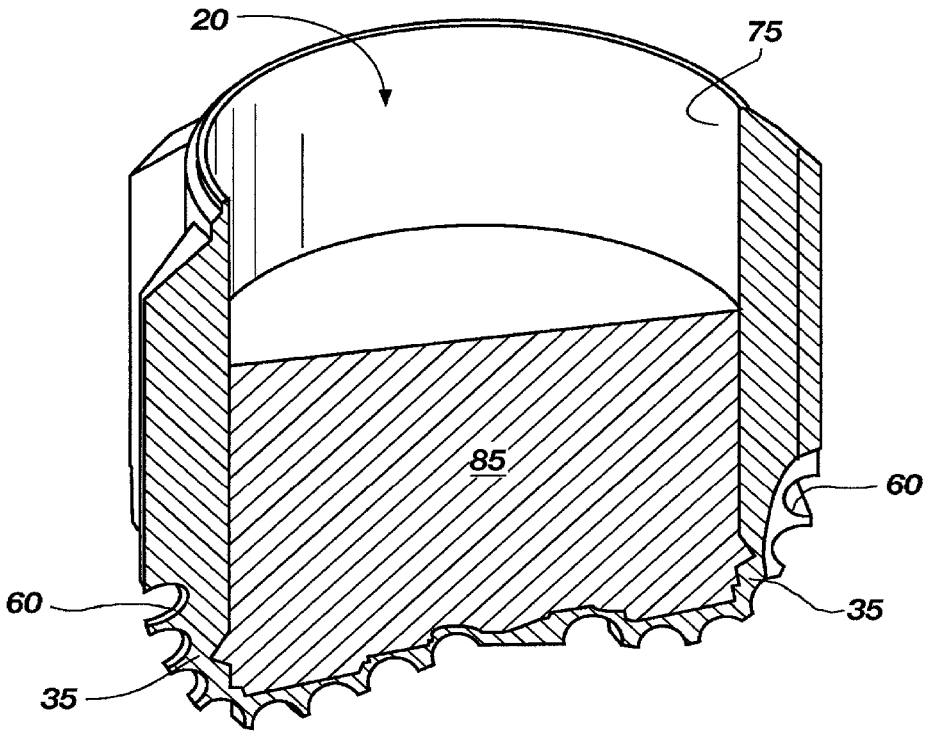
FIG. 3 is a cross-sectional view of the embodiment illustrated in FIG. 2 including a composite inlay structure positioned therein.

Some embodiments of the present invention may comprise a structural reinforcement inlay positioned inside the hollow bit body 15 and configured to fit inside and fill a portion of the hollow bit body 15. FIG. 3 depicts a cross-sectional view of the bit body 15 of FIG. 2 having a structural inlay 85 positioned inside the hollow bit body 15. The structural inlay 85 may be configured to fill the entire bit body 15, according to some embodiments, or the structural inlay 85 may be configured to fill only a portion of the bit body 15, according to other embodiments. The structural inlay 85 is configured to at least fill the portion of the bit body 15 adjacent the face 30, including filling any recesses 80 that may be present. Furthermore, the structural inlay 85 may also comprise fluid paths (not shown) in connection with the nozzles 70 for directing the drilling fluid through the interior of the bit body 15 to the nozzles 70.

Structural inlay 85 may be formed of a fiber-reinforced composite material, wherein fibers, either individually or in the forms of mats or tows, are disposed within a matrix material. The matrix material may comprise a hardenable or curable resin, such as an epoxy, thermoplastic, or a phenolic resin matrix. By way of example and not limitation, suitable commercially available curable phenolic resins may include SC-I008 from Borden Chemical Inc. of Columbus, Ohio, as well as 91-LD phenolic resin from Stuart-Ironsides Inc. of Chicago, Ill. Alternative non-limiting examples of suitable matrix materials may include Polyetherketone (PEK), Polyetherketoneketone (PEKK), or Polyetheretherketone (PEEK). By way of example and not limitation, the one or more fibers may comprise metal wire, carbon KEVLAR®, or ceramic materials.

Use of a bit "frame" or "skeleton" of metal, reinforced with a high-strength but more easily drillable composite material, may substantially reduce drill-out time and damage to the drill-out bit after cementing of the casing or liner string. In addition, portions of the exterior of the bit face 30, as well as the blades 35, may be formed of the composite material used for forming the structural inlay 85. In such embodiments, the composite material portions of the bit face 30 and blades 35 may have bonded thereon a preformed outer "armor" shell of an abrasion-resistant and erosion-resistant material for enhanced durability during drilling. Such a shell may be formed as a single piece, or in segments for ease of application.

Figure 4A:
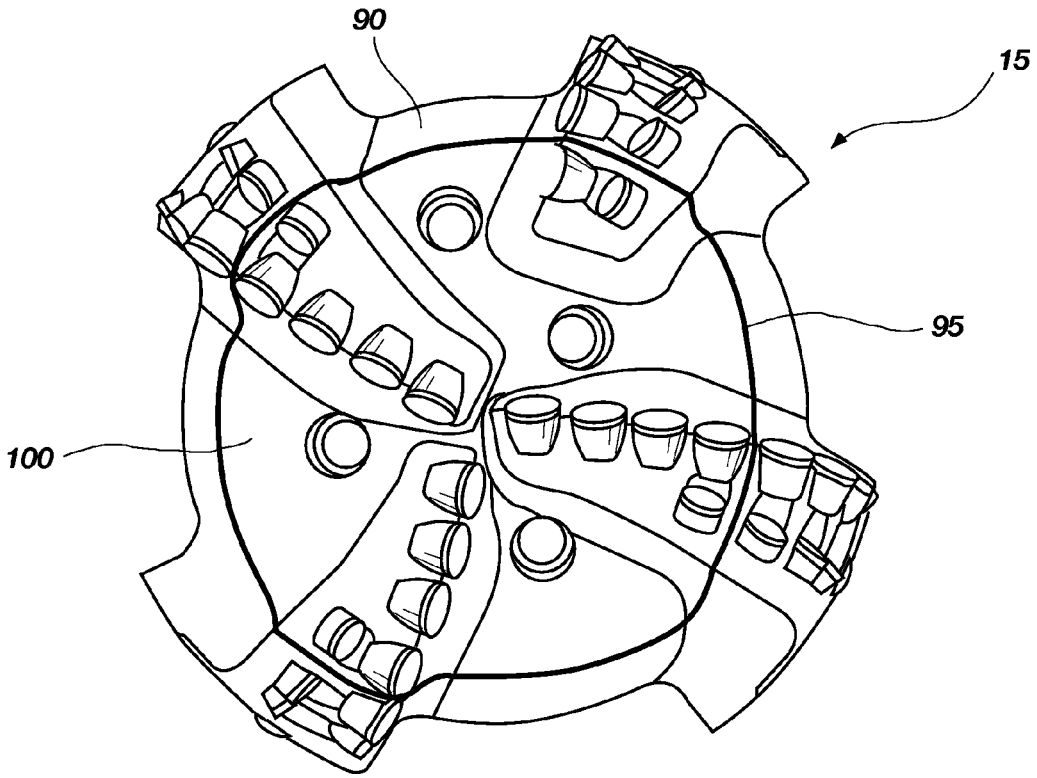
FIGS. 4A and 4B depict a casing bit that has an outer portion that is case hardened and an inner portion relating to a drill-out diameter that is not case hardened.
Figure 4B:
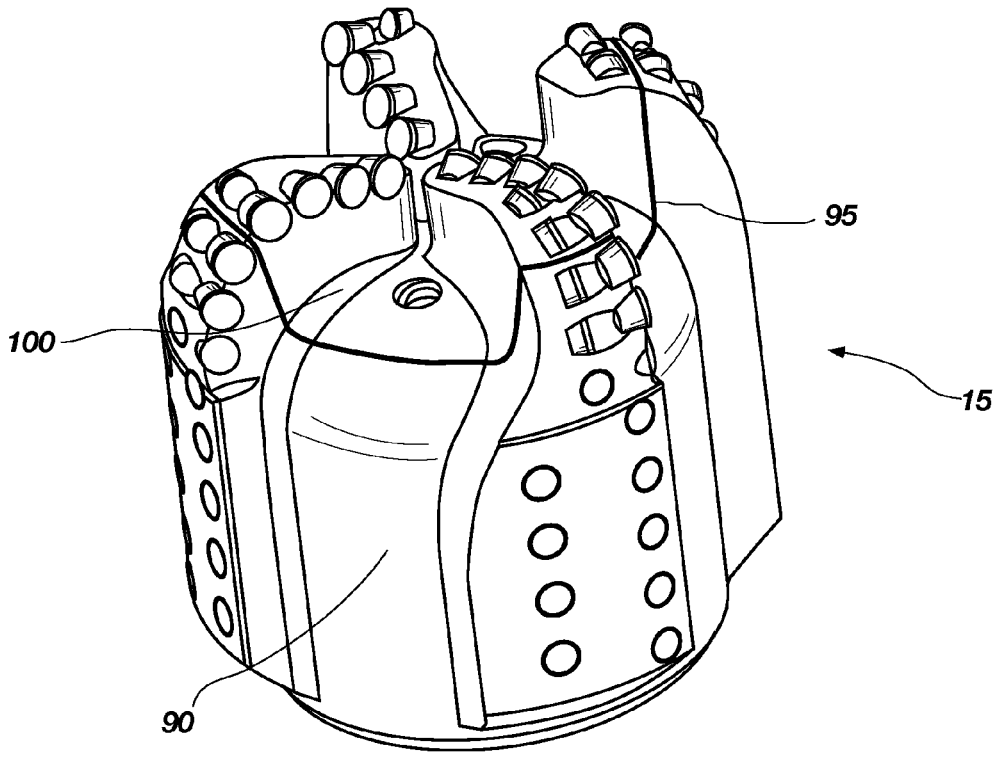

In at least some embodiments of the present invention, portions of an outer surface of the bit body 15 may be hardened by a case hardening technique. The bit body 15 may be case hardened over the outer surfaces of the bit body 15 at those areas outside the drill-out diameter, as illustrated in FIGS. 4A and 4B by the area 90 located radially outside of line 95. Case hardening may be accomplished using conventional hardening techniques. By way of example and not limitation, the bit body 15 may be hardened by carburizing, nitriding, or carbonitriding. Carburizing may be suitable for low carbon, low alloy steels and low carbon, plain carbon steels. Some non-limiting examples include those steels designated by AISI numbers 9310, 8620, 4815, 4715, 1018, and 1020. Nitriding may be suitable for low carbon or plain carbon steel. Carbonitriding may be suitable for any low carbon and low alloyed or plain carbon steels.

In order to case harden specific areas on the bit body 15, conventional techniques may be employed. By way of example and not limitation, in some embodiments, conventional "no-carb" stop-off paint may be applied to those areas in which it is desired that there be no case hardening. The configuration and size of this area may depend on the specific application. In the example in FIGS. 4A and 4B, the stop-off paint may be applied to the surfaces of the bit body 15 located radially inside line 95 and indicated as surface 100. In such embodiments, the stop-off paint inhibits case hardening in the areas in which it is applied, and the bit body 15 will comprise a portion of the bit body 15, which is hardened, and a portion of the bit body 15, which remains less hard and more easily drillable.

In use, a casing bit is affixed to the leading end of a casing string (not shown), and rotated by the casing string under applied WOB to cause the PDC cutting elements 65 to shear formation material from the formation and form a bore hole. The formation cuttings are removed from the casing bit face 30 by drilling fluid supplied to the bit face 30 through the casing string and the nozzles 70. Once the casing bit is positioned in place, such as by cementing the casing string in place using conventional methods, a drill bit run on a drill string or run on subsequent casing within the casing string may be used to drill beyond the depth of the casing bit. In such a case, the drill bit may drill through the casing bit, cement at the end of the casing string, and any associated components.

Embodiments of the present invention also include a method of making casing bits. Such methods may include forming a casing bit crown comprising a hollow bit body. The hollow bit body may be formed generally cylindrically. In some embodiments, a plurality of blades may be formed integral to the bit crown and over a face thereof. The bit crown may also include recesses formed in the inner surface of the blades. In other embodiments, a plurality of blades may be formed separate from the bit body and may be attached to the face of the bit body.

A plurality of cutting elements may be attached to the blades using conventional methods, as are generally known. A composite material may be disposed within the hollow bit body to fill at least a portion of the hollow bit body, including any recesses formed in relation to the blades. In some embodiments, the composite material may be positioned to complete at least a portion of an incomplete face structure. The composite material may be heated and exposed to pressure, as in an autoclaving process, when disposed with relation to the bit body and cured to a final density. By way of example and not limitation, the composite material may be heated to a temperature above its melting point and pressed into the hollow bit body as well as into any features, such as recesses therein. The composite material may then be allowed to cool to a solidified state while pressure is maintained on the material. Furthermore, in some embodiments, portions of the bit body may be selectively case hardened, as hereinabove described.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and equivalents, of the claims which follow.

What is claimed is:

1. A bit crown, comprising: a body comprising a generally rounded face at one longitudinal end thereof, the body being substantially hollow; and two or more blades over the face and extending generally radially outward from a center of the face, each of the two or more blades having a plurality of cutting elements attached thereto, at least one blade comprising an enclosed recess formed within the at least one blade, the recess extending from at least said face of said substantially hollow body and continuing into a portion of the at least one blade protruding from the body and carrying the plurality of cutting elements thereon.

2. The bit crown of claim 1, wherein the two or more blades are integral with the body, and wherein the two or more blades each include at least one recess therein extending from the hollow portion of the body.

3. The bit crown of claim 1, wherein the two or more blades are attached to the face of the body.

4. The bit crown of claim 3, wherein the two or more blades are attached to the face with at least one of a fastener and an adhesive.

5. The bit crown of claim 3, wherein the two or more blades are attached to the face with at least one of a bolt, a screw, a braze, a weld and a glue.

6. The bit crown of claim 1, wherein at least some of the plurality of cutting elements comprise polycrystalline diamond compact (PDC) material bonded to a short substrate having a length between 0.1 and 0.5 inch.

7. The bit crown of claim 1, wherein at least a portion of at least one of the body and the two or more blades comprise a case hardened material.

8. The bit crown of claim 7, wherein a radially outer portion of the face of the body and an entirety of the sidewall surfaces of the bit crown comprise the case hardened material.

9. The bit crown of claim 1, wherein the body comprises a sidewall comprising a thickness in a range between 0.050 inch and 0.200 inch.

10. The bit crown of claim 1, wherein:

said recess extends through said hollow body.

11. An earth-boring tool, comprising: a crown comprising a generally cylindrical hollow body comprising an open end and an opposing, closed end comprising a generally rounded face; a plurality of blades extending radially outward from the face; a plurality of cutting elements attached to the plurality of blades; and a structural inlay comprising a composite material positioned at least within a portion of the hollow body and at the closed end thereof and extending into at least one enclosed recess formed within at least one blade of the plurality of blades, the at least one recess extending at least from said face of the hollow body and continuing on into a portion of the at least one blade.

12. The earth-boring tool of claim 11, wherein the plurality of blades are integral to the body.

13. The earth-boring tool of claim 11, wherein the plurality of blades are attached to the face of the crown.

14. The earth-boring tool of claim 13, wherein the plurality of blades are attached to the face with at least one of a fastener and an adhesive.

15. The earth-boring tool of claim 13, wherein the plurality of blades are attached to the face with at least one of a bolt, a screw, a braze, a weld and a glue.

16. The earth-boring tool of claim 11, wherein each blade of the plurality of blades comprises at least one recess extending from inside the hollow body and into a portion of the respective blade.

17. The earth-boring tool of claim 11, wherein at least some of the plurality of blades extend from and are integral to the structural inlay.

18. The earth-boring tool of claim 11, wherein at least some of the plurality of cutting elements comprise polycrystalline diamond compact (PDC) material bonded to a short substrate having a length between 0.1 and 0.5 inch.

19. The earth-boring tool of claim 11, wherein:

said recess extends through said hollow body.

20. A method of forming an earth-boring tool attachable to a casing string, comprising:

forming a bit body comprising crown comprising a generally cylindrical hollow body having a hollow interior and comprising an open end and an opposing, closed end comprising a generally rounded face;

forming a plurality of blades extending radially outward from the face;

attaching a plurality of cutting elements to the plurality of blades;

forming at least one recess extending from the hollow interior of the bit body into a portion of at least one blade of the plurality of blades; and positioning a structural inlay of composite material at least inside a portion of the hollow interior of the bit body at the closed end thereof and extending into at least one enclosed recess formed within at the least one blade of the plurality of blades, said recess extending at least from said face of said bit body and continuing on into at least one of said blades.

21. The method of claim 20, wherein forming a plurality of blades extending radially outward from the face comprises attaching the plurality of blades to the face.

22. The method of claim 21, wherein attaching the plurality of blades to the face comprises attaching the plurality of blades to the face using at least one of a fastener and an adhesive.

23. The method of claim 21, wherein attaching the plurality of blades to the face comprises attaching the plurality of blades to the face using at least one of a bolt, a screw, a braze, a weld and a glue.

24. The method of claim 20, wherein forming plurality of blades extending radially outward from the face comprises forming the bit body and the plurality of blades as an integral structure.

25. The method of claim 24, wherein forming at least one recess extending from the hollow interior of the bit body into a portion of the at least one blade of the plurality of blades comprises forming at least one recess in at least some blades of the plurality of blades.

26. The method of claim 20, wherein forming the bit body comprises case hardening at least a portion of the bit body.

27. The method of claim 26, wherein case hardening at least a portion of the bit body comprises case hardening by carburizing, nitriding, or carbonitriding.

28. The method of claim 26, wherein case hardening at least a portion of the bit body comprises case hardening the portions of the bit body located outside a drill-out diameter of the bit body.

29. The method of claim 26, wherein case hardening at least a portion of the bit body comprises: applying a stop-off paint to an area comprising a drill-out diameter of the bit body; and carburizing, nitriding, or carbonitriding the bit body.

30. The method of claim 20, wherein forming the bit body comprises forming a frame having a thin outer sidewall and face portions providing an incomplete face structure.

31. The method of claim 30, further comprising completing at least a portion of the face with a composite material.

32. The method of claim 20, comprising:

extending said recess through said hollow body.

* * * * *